US006679576B2

(12) United States Patent
Crivelli

(10) Patent No.: US 6,679,576 B2
(45) Date of Patent: Jan. 20, 2004

(54) FLUID EJECTION DEVICE AND METHOD OF OPERATING

(75) Inventor: Paul Crivelli, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 116 days.

(21) Appl. No.: 09/908,312

(22) Filed: Jul. 17, 2001

(65) Prior Publication Data

US 2003/0016262 A1 Jan. 23, 2003

(51) Int. Cl.[7] ..... B41J 2/14
(52) U.S. Cl. ..... 347/17; 347/26; 347/47
(58) Field of Search ..... 347/6, 17, 26, 347/47, 56, 60, 61, 62, 65, 100

(56) References Cited

U.S. PATENT DOCUMENTS 5,208,605 A * 5/1993 Drake ..... 347/15
5,463,413 A * 10/1995 Ho et al. ..... 347/65
5,646,654 A 7/1997 Widder et al. ..... 347/14
5,814,683 A 9/1998 Branham ..... 523/161
5,912,685 A * 6/1999 Raman ..... 347/65
5,992,979 A 11/1999 Barbour et al. ..... 347/60
6,039,428 A 3/2000 Juve ..... 347/19
6,139,125 A * 10/2000 Otsuka et al. ..... 347/11
6,149,264 A * 11/2000 Hirabayashi et al. ..... 347/43
6,155,673 A * 12/2000 Nakajima et al. ..... 347/61
6,338,545 B1 * 1/2002 Sekiya ..... 347/47

OTHER PUBLICATIONS

Frank Cost, Pocket Guide to Digital Printing, 1997, Delmar Publishers, pp. 195–196.*

* cited by examiner

*Primary Examiner*—Stephen D. Meier
*Assistant Examiner*—Blaise Mouttet

(57) ABSTRACT

A fluid ejection device has an orifice plate with an orifice therein, and a heating element that heats fluid and ejects the fluid through the orifice that is associated with the heating element. The orifice has an exit area O, and the heating element has an effective surface area R, wherein a ratio R/O is below about 2.

22 Claims, 2 Drawing Sheets

FLUID EJECTION DEVICE AND METHOD OF OPERATING

FIELD OF THE INVENTION

The present invention relates generally to fluid ejection devices.

BACKGROUND OF THE INVENTION

Inkjet printing is a non-impact printing process in which droplets of fluid are deposited on print media, such as paper, transparency film, label stock, textile and other materials. Essentially, inkjet printing involves the ejection of fine droplets of fluid onto the print media in response to electrical signals generated by a microprocessor.

Generally, there are two types of inkjet printers for achieving fluid droplet ejection: thermal and piezoelectrical. In thermal inkjet printing, electrical resistance heating is used to vaporize the fluid, which is expelled through an orifice in an inkjet printhead (or fluid ejection device) toward the print medium. A microprocessor selects the appropriate resistors to be fired and directs an electrical current thereto to achieve resistive heating and consequential ejection of fluid vaporized by the heating through the orifice associated with the selected resistor. In piezoelectric inkjet printing, the fluid droplets are physically ejected due to vibration of piezoelectric crystals that are energized by electrical signals generated by a microprocessor.

During printing, small fluid droplets are ejected in large quantities, particularly with large throughput printers that use a large fixed array of printheads or a scanning carriage on which a number of inkjet printheads are mounted. In large printers, the printheads typically carry a small supply of fluid across the print zone. The supply is often continuously or intermittently replenished through tubing that extends to the carriage borne printheads from remote or so-called "off-axis" stationary reservoirs in the printer. Fine aerosol comprising fluid droplets which do not reach their intended destination on the print medium often collect in undesirable locations on the printer, and on various areas of the printheads which are not normally wiped and cleaned at the printhead service station. Visible amounts of aerosol fluid droplets can be deposited on unintended areas of the print media, as well. The problem is particularly acute when pigment-based rather than dye-based inks are used since pigment-based inks contain a high proportion of undissolved color particles suspended in a volatile organic carrier which has a particularly high tendency to clog the printhead nozzle orifices and can also get on the operator's hands or clothing. Often, nozzles with smaller orifice diameters have a tendency to crust over or clog. On the other hand, nozzles with larger orifice diameters have larger volume fluid droplets ejected and associated increased power to vaporize the fluid.

It is accordingly desired to reduce aerosol generation in inkjet printing while avoiding clogging of the printhead orifices.

SUMMARY

In one embodiment of the present invention a printhead has an orifice plate with an orifice therein, and a heating element that heats fluid and ejects the fluid through the orifice that is associated with the heating element. The orifice has an exit area O, and the heating element has an effective surface area R. In one embodiment, a ratio R/O is below about 2.

Many of the attendant features of this invention will be more readily appreciated as the same becomes better understood by reference to the following detailed description and considered in connection with the accompanying drawings in which like reference symbols designate like parts throughout.

DETAILED DESCRIPTION

Figure 1:
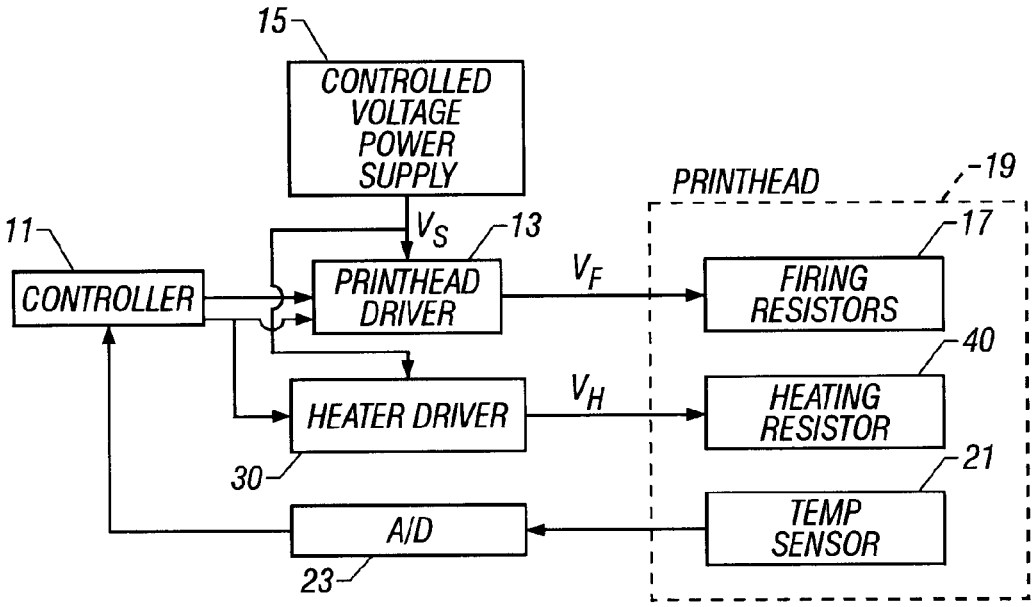
FIG. 1 is a block diagram of thermal inkjet printhead firing and heating components pursuant to an embodiment of the present invention.

Referring now to FIG. 1, shown therein is a simplified block diagram of a thermal inkjet printer that employs the techniques of the present invention. In one embodiment, a controller 11 of the printer receives print data input and processes the print data to provide print control information to a printhead driver circuit (or printhead driver) 13. In one embodiment, the printhead driver circuit 13, as controlled by the controller 11, applies pulses of voltage $V_F$ to a thin film integrated circuit thermal inkjet printhead (or fluid ejection device) 19 which includes firing resistors (or heating elements) 17. The firing resistors 17 vaporize fluid to fire fluid in droplets through orifices 18 (FIG. 2A) in an orifice plate 20. In one embodiment, the fluid fired is ink. In another embodiment, the fluid fired is a solid, such as powders. In another embodiment, the fluid fired is a gas. In another embodiment, the fluid fired is pigment-based ink. In another embodiment, the fluid fired is dye-based ink.

In one embodiment, a controlled voltage power supply 15 of the printer provides a controlled supply voltage $V_S$ to the printhead driver circuit 13, associated with the voltage $V_F$, and to a heater driver circuit (or heater driver) 30, associated with a heating voltage $V_H$, described in more detail below. In one embodiment, the magnitudes of the firing voltage $V_F$ and the heating voltage $V_H$ are controlled by the controller 11. In another embodiment, the magnitudes of the firing voltage $V_F$ and the heating voltage $V_H$ are controlled by their respective drivers. The voltage pulses $V_F$ are typically applied to contact pads on the printhead that are electrically coupled with the firing resistors 17 by conductive traces. In one embodiment, the pulse voltage actually received by the firing resistor 17 is typically less than the firing voltage $V_F$ applied at the electrical contact pad.

In one embodiment, the controller 11 has a microprocessor architecture in accordance with known controller structures, and provides firing pulse width and frequency parameters to the printhead driver circuitry 13. In turn, the driver circuitry 13 produces firing voltage pulses of width and frequency as selected by the controller and with a voltage $V_F$ that depends on the supply voltage $V_S$.

Figure 2A:
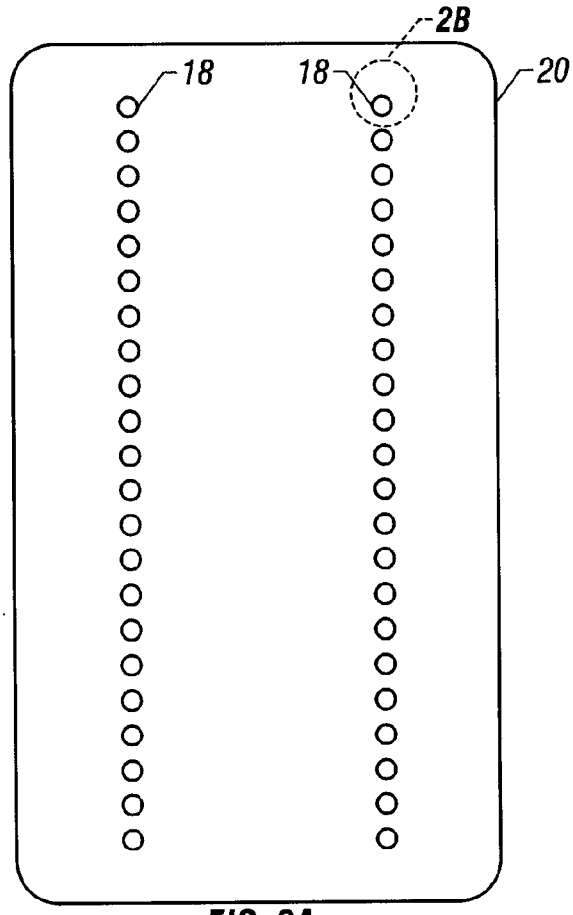
FIG. 2A is a schematic plan view of a printhead orifice plate pursuant to an embodiment of the invention.

In one embodiment, the integrated circuit printhead seen in FIG. 1 includes a temperature sensor 21 that determines a temperature of the orifice plate 20 (shown in FIG. 2A). In one embodiment, the sensor is located proximate the firing resistors 17. In one embodiment, the sensor 21 determines an electrical signal representative of the temperature of the orifice plate. In one embodiment, the signal is provided to the controller. In one embodiment, the sensor 21 determines an analog signal. The analog output of the temperature sensor 21 is supplied to an analog to digital (A/D) converter 23 that provides a digital input to the controller 11. The digital output of the A/D converter 23 is indicative of the temperature detected by the sensor 21.

In one embodiment, the orifice plate 20 of the printhead is warmed to above about ambient temperature. In another embodiment, the plate 20 is maintained at the about ambient temperature during printing. In one embodiment, the orifice plate is heated by periodically applying pulse warming power to the firing resistors 17 at power levels lower than necessary to fire ink droplets through the orifices 18.

In another embodiment, the orifice plate is heated by providing a separate orifice plate heating resistor (heater) 40 in the printhead 19. The heating resistor 40 is supplied periodic voltage pulses $V_H$ from the heater driver 30 in the printer. In one embodiment, the heater driver is controlled by the controller 11 in accordance with the temperature of the orifice plate 20 as sensed by the sensor 21.

In one embodiment, the method of warming the orifice plate 20 is by applying trickle current to the firing resistors 17. In one embodiment the orifice plate 20 is warmed by application of a small trickle current through only one or a few of a plurality of parallel connected field effect transistors (FETs) which control application of low heating power to each of the firing resistors 17. In this way, the FET acts as a high resistance resistor in series with the lower resistance firing resistor and thereby consumes more current and can be used for warming the orifice plate 20 in accordance with the sensed temperature without electrically firing the resistors 17 at power levels which produce fluid droplets.

In another embodiment, an additional temperature controlled field effect transistor (FET) is used to supply printhead warming power to each firing resistor. FETs are also used to apply higher voltage firing pulses to the firing resistor associated with each orifice in the orifice plate. Alternatively, a single heating resistor 40 is used to warm a substantial area of the orifice plate 20.

In another embodiment, a combination of both trickle and pulse warming techniques is used. A continuous trickle current is supplied or a heating voltage pulses $V_H$ is periodically supplied to heat the heating firing resistors 17, and to heat the orifice plate 20. The orifice plate is heated to an above ambient temperature, which should preferably be maintained in the range of about 40° C. to 60° C. In one embodiment, the orifice plate temperature is maintained in this temperature range before commencement of and/or during the printing operation. Often, the temperature of the orifice plate 20 varies during intense printing and cools during protracted periods of non-firing of the various firing resistors 17.

Figure 2B:
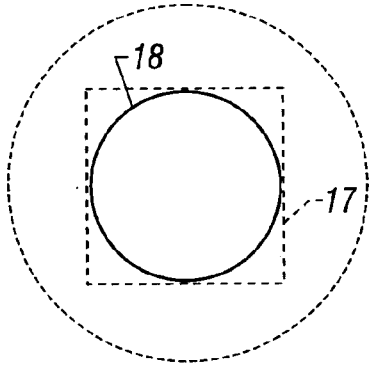
FIG. 2B is a schematic view of an orifice and heating element to an enlarged scale.

In one embodiment, a schematic plan or layout view of the orifice plate suitable for use in a high throughput printer is shown in FIG. 2A. (A high throughput printer is an off-axis printer which may incorporate up to a 60" or more wide print swath which ordinarily results in a relatively high fluid aerosol generation during printing.) As seen in FIG. 2A, the orifice plate 20 has a number of circular orifices 18 extending therethrough. Each orifice has a cross sectional area O at the exit area or discharge end of the orifice (FIG. 2B).

Figure 3:
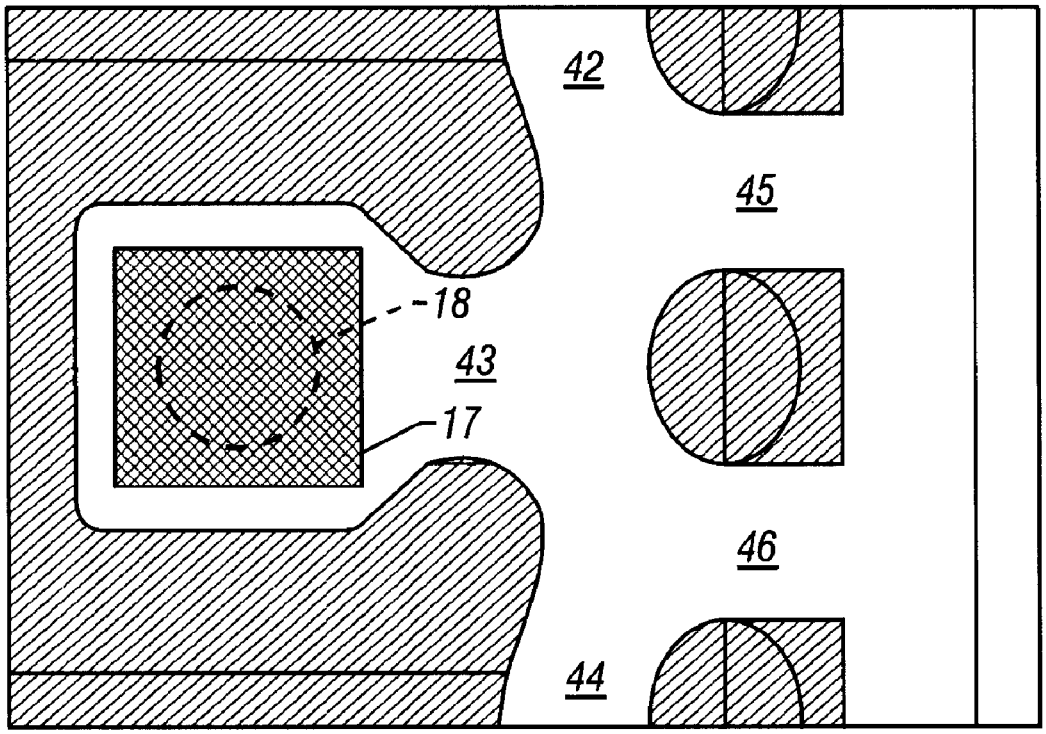
FIG. 3 is a greatly enlarged plan view of the layout of a portion of the orifice plate in one embodiment.

As shown in the embodiment illustrated in FIG. 3, one of the firing resistors 17 is associated with each orifice 18 to rapidly heat the fluid in a firing chamber 43 on the printhead. Fluid is conducted into the firing chamber 43 through fluid channels 42 to 46 in the printhead. The firing chamber is depicted in plan view in FIG. 3. The firing chamber has two opposing side walls that are substantially parallel to each other, and a rear wall coupling the side walls. Corners that couple the side walls to the rear wall are substantially rounded. There is also an entrance wall opposite the rear wall. The entrance wall has an entranceway for ink to flow therethrough. Edges adjacent the entranceway are rounded. Corners that couple the entrance wall to the side walls are rounded and obtusely angled.

In one embodiment, the printhead has low aerosol generation of fluid by selecting a value below about 2 for the ratio R/O of the effective surface area R of the firing resistor 17 to the exit cross sectional area O of the printhead orifice 18 (See FIG. 2B). In another embodiment, the R/O ratio is between about 1.27 and about 2. As used herein, the term "effective surface area R" refers to the surface area of the side of the firing resistor that faces the associated orifice 18. In one embodiment, square resistors 17 and round orifices 18 are used. In one embodiment, a ratio of L/D relating a side edge length of a square resistor to the diameter of a round orifice is about 1.25 or less. L is thus a linear dimension related to the square root of the effective surface area R of the resistor and D is a dimension related by $\pi$ to the area O of the exit end of a nozzle plate orifice.

In one embodiment, the printhead orifice plate 20 is warmed to an above ambient temperature of about 40° C. or higher before commencement of a printing operation. In one embodiment, during printing the orifice plate is regularly maintained at a temperature of about 40° C. or higher.

In another embodiment, the R/O ratio is equal to or less than about 2 and the orifice plate temperature is about 40° C. or higher. In one embodiment, the proportion of aerosol formed during printing is significantly reduced and clogging of the printhead orifices is substantially avoided.

Those skilled in the art will appreciate that in one embodiment, the printer has a printhead carriage on which up to six or more printheads associated with different ink colors are mounted. In one embodiment, each printhead is capable of depositing as many as two ink droplets (total of 12 or above) each having a nominal drop volume of 20 picoliters to form one 600 dpi pixel. This can result in use of as much as 0.311 L of ink to produce a single print. With such high ink volumes encountered in high throughput inkjet printers, aerosol generation is significant. In one embodiment, maintaining the R/O ratio at or below about 2, in conjunction with maintaining the inkjet orifice plate 20 at a temperature of about 40° C. or above during printing, significantly reduces aerosol generation without orifice clogging when using pigment based ink.

It is therefore to be understood that this invention may be practiced otherwise than as specifically described. Thus, the present embodiments of the invention should be considered in all respects as illustrative and not restrictive, the scope of the invention to be indicated by the appended claims rather than the foregoing description.

What is claimed is:

1. A fluid ejection device comprising:

an orifice plate having an orifice with an exit area O configured to avoid clogging of pigment based ink in the orifice while reducing aerosol generation of the pigment based ink;

a heating element that heats the pigment based ink and the orifice plate above about ambient temperature during printing and ejects said ink through the orifice, wherein said heating element has an effective surface area R, wherein a ratio R/O is in the range of about 1.27–2; and a firing chamber associated with the heating element and the orifice, wherein said ink is heated in the firing chamber, wherein the firing chamber has a single fluid entrance.

2. The fluid ejection device of claim 1 further comprising an orifice plate temperature sensor that senses a temperature of said orifice plate.

3. The fluid ejection device of claim 2 further comprising at least one orifice plate heater, wherein the orifice plate is heated to a temperature above about ambient temperature.

4. The fluid ejection device of claim 1 wherein the orifice has an exit diameter D, and the heating element is square with a side edge L, and wherein L/D is below about 1.25.

5. A fluid ejection device comprising:

an orifice plate having an orifice therein with an exit area having a mechanical feature that avoids clogging of pigment based ink in the orifice while reducing aerosol generation of the pigment based ink;

a heating element that heats the pigment based ink and the orifice plate above about ambient temperature during printing and ejects said ink through the orifice; and a firing chamber associated with the heating element and the orifice, the firing chamber having a single fluid entrance, wherein said fluid is heated in the firing chamber and wherein a ratio of a surface area of the heating element to the exit area of the orifice is in the range of about 1.27–2.

6. The fluid ejection device of claim 5 wherein the fluid ejection device has a heater to warm the orifice plate to a temperature above about ambient temperature.

7. The fluid ejection device of claim 5 further comprising an orifice plate temperature sensor that senses a temperature of said orifice plate.

8. The fluid ejection device of claim 5 further comprising an orifice plate temperature sensor that senses a temperature of said orifice plate.

9. A printhead comprising:

an orifice plate having an orifice therein having an exit area;

a resistor for heating pigment bused ink to eject said ink through the orifice and for heating the orifice plate above about ambient temperature during printing, said resistor having an effective surface area that is dimensionally related to the exit area of the orifice so that a ratio of the surface area of the resistor to the exit area of the orifice is in the range of about 1.27–2 to avoid clogging of the pigment based ink in the orifice while reducing aerosol generation of the pigment based ink; and a firing chamber associated with the heating element and the orifice, wherein said fluid is heated in the firing chamber, and the firing chamber has a single fluid entrance.

10. The printhead of claim 9 wherein the resistor for heating the orifice plate is a heating resistor.

11. The printhead of claim 10 wherein the resistor for heating the fluid is a firing resistor associated with the orifice.

12. The printhead of claim 9 wherein the resistor for heating fluid and the resistor for heating the orifice plate is a firing resistor.

13. The printhead of claim 9 further comprising a means for sensing a temperature of the orifice plate.

14. The printhead of claim 13 wherein the means for sensing the orifice plate temperature is used to control the resistor for heating.

15. The printhead of claim 9 wherein the orifice plate is heated to a temperature above about ambient temperature.

16. The printhead of claim 9 wherein said orifice plate is substantially maintained at a temperature in the range of about 40 to 60° C. during printing.

17. A method of operating a fluid ejection device comprising:

supplying pigment based ink through a single fluid entrance to a chamber that is in fluid communication with a nozzle orifice having an exit area in the nozzle orifice;

periodically applying firing pulses to a heating element having an effective surface area in the fluid ejection device to thermally eject said fluid from the orifice that is associated with the heating element, wherein a ratio of the surface area of the heating element to the exit area of the orifice is in the range of about 1.27–2; and warming an orifice plate above ambient temperature during printing to avoid clogging of the pigment based ink in the orifice while reducing aerosol generation of the pigment based ink.

18. The method of claim 17 further comprising sensing a temperature of said orifice plate.

19. The method of claim 17 further comprising using the heating element to heat said orifice plate.

20. The method of claim 17 further comprising using the temperature of the orifice plate to control the heating element.

21. The method of claim 17 further comprising using a heater coupled with the orifice plate to warm the plate.

22. The method of claim 17, wherein said temperature of said orifice plate is maintained in the range of 40–60° C. during printing.

* * * * *